US011261874B2

(12) United States Patent
Wang

(10) Patent No.: US 11,261,874 B2
(45) Date of Patent: Mar. 1, 2022

(54) AXIAL FLOW FAN WITH HIGH TEMPERATURE RESISTANCE FOR SHIP DESULFURIZATION SYSTEM

(71) Applicant: Shandong Pure Ocean Technology Co., Ltd, Weihai (CN)

(72) Inventor: Xiaotian Wang, Weihai (CN)

(73) Assignee: Shandong Pure Ocean Technology Co., Ltd, Weihai (CN)

( * ) Notice: Subject to any disclaimer, the term of this patent is extended or adjusted under 35 U.S.C. 154(b) by 356 days.

(21) Appl. No.: 16/334,375

(22) PCT Filed: Nov. 16, 2017

(86) PCT No.: PCT/CN2017/111281
§ 371 (c)(1),
(2) Date: Mar. 19, 2019

(87) PCT Pub. No.: WO2019/071706
PCT Pub. Date: Apr. 18, 2019

(65) Prior Publication Data

US 2021/0148375 A1 May 20, 2021

(30) Foreign Application Priority Data

Oct. 13, 2017 (CN) ..... 201710954824.6
Oct. 13, 2017 (CN) ..... 201721325115.3

(51) Int. Cl.
*F04D 29/063* (2006.01)
*F04D 19/00* (2006.01)
(Continued)

(52) U.S. Cl.
CPC ..... *F04D 29/063* (2013.01); *F04C 3/04* (2013.01); *F04C 29/04* (2013.01); *F04D 19/002* (2013.01);
(Continued)

(58) Field of Classification Search
CPC ... F04D 7/00; F04D 7/06; F04D 19/00; F04D 19/002; F04D 17/16; F04D 17/165;
(Continued)

(56) References Cited

U.S. PATENT DOCUMENTS 2,098,407 A * 11/1937 Smith, Jr. ..... F04D 25/08
416/170 R
2,223,847 A * 12/1940 Engdahl ..... F04D 19/002
384/476
3,942,584 A * 3/1976 Wieser ..... F04D 29/588
165/47

FOREIGN PATENT DOCUMENTS

CN 2105580 U 5/1992
CN 2364255 Y 2/2000
(Continued)

*Primary Examiner* — Philip E Stimpert
(74) *Attorney, Agent, or Firm* — Bayramoglu Law Offices LLC

(57) ABSTRACT

An axial flow fan with high-temperature resistance for a ship desulfurization system includes a fan casing, axial flow fan blades, a high-temperature resistant bearing, and a cold water pipe. The axial flow fan blades are coaxially configured at an inner front end of the fan casing, and a rotating shaft is inserted in a middle of the axial flow fan blade. A middle part of the rotating shaft is sleeved with two high-temperature resistant bearings, and outsides of the two high-temperature resistant bearings are fixedly provided with a cruciform axis support. A rear end of the rotating shaft is sleeved with a worm gear, and an upper end of the worm gear is provided with a worm. The worm gear meshes with the worm. The worm gear and the worm are configured inside a lubricating oil casing, and the lubricating oil casing is covered with the insulating layer.

4 Claims, 1 Drawing Sheet

(51) Int. Cl.

| | |
|---|---|
| ***F04D 29/053*** | (2006.01) |
| ***F04D 29/056*** | (2006.01) |
| ***F04D 29/58*** | (2006.01) |
| ***F04C 3/04*** | (2006.01) |
| ***F04C 29/04*** | (2006.01) |

(52) U.S. Cl.
CPC ..... *F04D 29/053* (2013.01); *F04D 29/056* (2013.01); *F04D 29/584* (2013.01); *F04C 2240/30* (2013.01)

(58) Field of Classification Search
CPC ..... F04D 29/056; F04D 29/059; F04D 29/06; F04D 29/063; F04D 29/584; F04D 29/5853; F04D 29/5846; F04D 29/053; F16C 19/525; F04C 2240/30; F04C 29/04; F04C 3/04
See application file for complete search history.

(56) References Cited

FOREIGN PATENT DOCUMENTS

| | | | |
|---|---|---|---|
| CN | 202811409 | U | 3/2013 |
| CN | 203867948 | U | 10/2014 |
| CN | 204572521 | U | 8/2015 |
| CN | 204663995 | U | 9/2015 |
| CN | 205638976 | U | 10/2016 |
| GB | 2526094 | A | 11/2015 |

* cited by examiner

AXIAL FLOW FAN WITH HIGH TEMPERATURE RESISTANCE FOR SHIP DESULFURIZATION SYSTEM

CROSS REFERENCE TO THE RELATED APPLICATIONS

This application is the national phase entry of International Application No. PCT/CN2017/111281, filed on Nov. 16, 2017, which is based upon and claims priority to Chinese Patent Application No. CN201710954824.6, filed on Oct. 13, 2017, the entire contents of which are incorporated herein by reference.

TECHNICAL FIELD

The present invention relates to an axial flow fan, particularly to an axial flow fan with high temperature resistance for ship desulfurization system.

BACKGROUND

Since the exhaust emission standards of ships are promoted globally, ship desulfurization systems are increasingly used in the exhaust emission systems. The high-temperature flue gas in the transmission pipeline of the desulfurization system will cause an excessive engine back pressure. As a result, the engine will shut down or the exhaust will be unsmooth. Hence, generally, people realize the function of exhaust without installing an engine. However, this practice will obviously reduce the emission efficiency of flue gas and increase the labor cost. In order to solve the above problems, in some enterprises, the emission efficiency of flue gas is improved by installing centrifugal fans. However, with a large size, the centrifugal fans are space-consuming and inconvenient for installation and operation. Also, there are difficulties with maintenance and other aspects.

SUMMARY

In order to eliminate the drawbacks of the prior art described above, the present invention provides an axial flow fan with high temperature resistance for a ship desulfurization system.

In order to solve the above technical problems, the technical solution adopted by the present invention is as follows. An axial flow fan with high temperature resistance for a ship desulfurization system includes a fan casing, and further includes axial flow fan blades, a high-temperature resistant bearing, an insulating layer, and a cold water pipe. The axial flow fan blades are coaxially configured at an inner front end of the fan casing, and a rotating shaft is inserted in the middle of the axial flow fan blades.

The middle part of the rotating shaft is sleeved with the high-temperature resistant bearing. Two high-temperature resistant bearings are provided, and the two high-temperature resistant bearings are spaced apart. Outsides of the two high-temperature resistant bearings are fixedly provided with a cruciform axis support.

The rear end of the rotating shaft is sleeved with a worm gear, and the upper end of the worm gear is provided with a worm, and the worm gear meshes with the worm. The worm gear and the worm are configured inside a lubricating oil casing. The worm gear rotates along an axis under the driving of the worm and the rotating shaft and the axial flow fan blades are further driven to rotate.

The lubricating oil casing is covered with the insulating layer for blocking the high-temperature flue gas transmitted along the axial direction outside the insulating layer, thereby avoiding the rotating shaft and the high-temperature resistant bearings being in a high-temperature environment for a long time. A layer of corrosion-resistant steel is provided on the outer surface of the insulating layer to improve the mounting support for the insulating layer.

The cold water pipe is coiled and configured inside the insulating layer. Both ends of the cold water pipe extend out from the fan casing to form a cold water pipe inlet and a cold water pipe outlet, respectively. The inside of the insulating layer is cooled by injecting cold water into the cold water pipe.

The axial flow fan blades are fixedly configured at a front end of the rotating shaft through an end closed nut.

The front end of the lubricating oil casing is closely connected to the rear end of the axis support, and the high-temperature resistant bearing is configured at the end of the lubricating oil casing, so that the inside of the lubricating oil casing forms a closed space and is filled with lubricating oil.

An outer end of the worm is connected to an output shaft of the engine through a power device. The worm realizes an axial rotation through the engine and further drives the worm gear to rotate.

The present invention not only has the advantages of simple and compact structure and small occupation area, but also can obviously improve the emission efficiency of the flue gas, and has a wide applicability when applied to the ship desulfurization systems. In addition, the present invention has low production cost, long service life, and is convenient for installation and maintenance.

Figure 1:
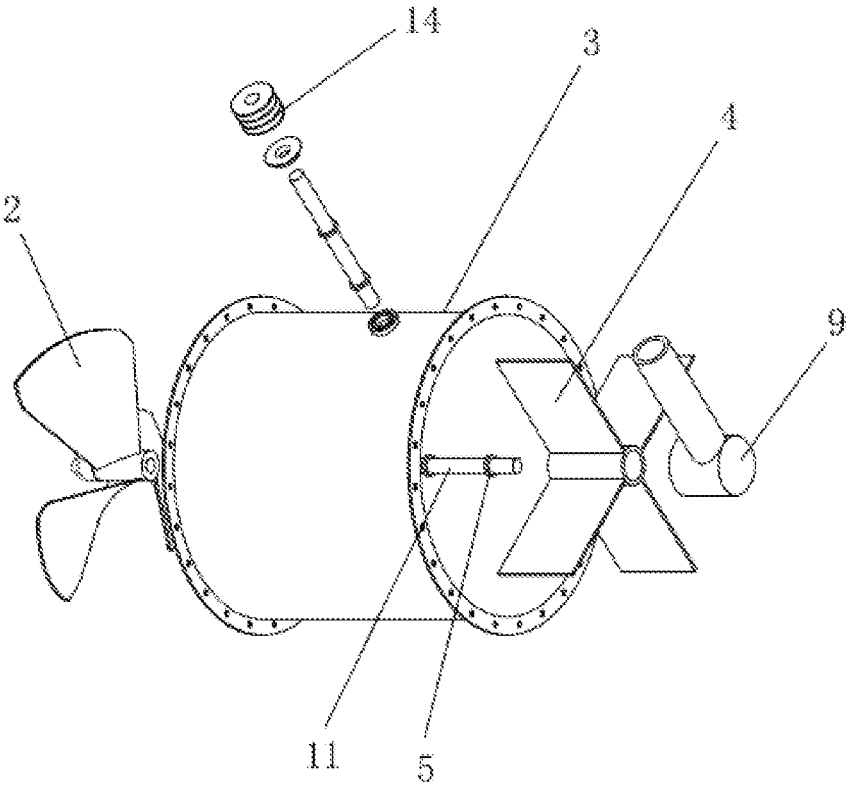
FIG. 1 is an exploded view of the present invention.

In the drawings: 1. end closed nut; 2. axial flow fan blade; 3. fan casing; 4. axis support; 5. high-temperature resistant bearing; 6. cold water pipe inlet; 7. cold water pipe outlet; 8. insulating layer; 9. lubricating oil casing; 10. corrosion-resistant steel; 11. rotating shaft; 12. worm gear; 13. worm; 14. power device.

DETAILED DESCRIPTION OF THE EMBODIMENTS

The present invention will be further described in detail below with reference to the drawings and specific embodiments.

Figure 2:
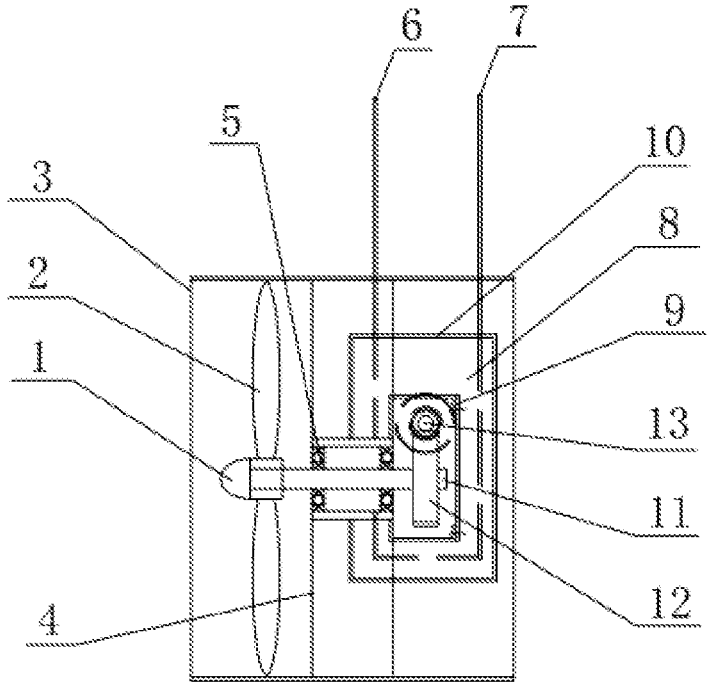
FIG. 2 is a sectional view of the present invention.

FIGS. 1-2 show an axial flow fan with high temperature resistance for ship desulfurization system, including a fan casing 3, and further including axial flow fan blades 2, a high-temperature resistant bearing 5, an insulating layer 8, and a cold water pipe. The axial flow fan blades 2 are coaxially configured at an inner front end of the fan casing 3, and a rotating shaft 11 is inserted in a middle of the axial flow fan blades 2. The axial flow fan blades 2 are fixedly configured at a front end of the rotating shaft 11 through an end closed nut. The material of the axial flow fan blades 2 is corrosion-resistant and high-temperature resistant stainless-steel materials.

The middle part of the rotating shaft 11 is sleeved with the high-temperature resistant bearing 5. Two high-temperature resistant bearings 5 are provided, and the two high-temperature resistant bearings are spaced apart. Outsides of the two high-temperature resistant bearings are fixedly provided with a cruciform axis support 4. In one aspect, the axis support 4 can be used to fix the high-temperature resistant bearing 5. In the other aspect, the axis support 4 can further provide mounting support for the lubricating oil casing 9, the insulating layer 8 and the corrosion-resistant steel 10.

The rear end of the rotating shaft 11 is sleeved with a worm gear 12, and the upper end of the worm gear 12 is provided with a worm 13. The worm gear 12 meshes with the worm 13. The worm gear 12 and the worm 13 are both configured inside the lubricating oil casing 9. A front end of the lubricating oil casing 9 is closely connected to a rear end of the axis support 4, and the high-temperature resistant bearing 5 is configured at the end of the lubricating oil casing 9, so that the inside of the lubricating oil casing 9 forms a closed space which is filled with lubricating oil.

The worm gear 12 rotates along the axis under the driving of the worm 13, and the rotating shaft 11 and the axial flow fan blades 2 are further driven to rotate. An outer end of the worm 13 is connected to an output shaft of the engine through a power device 14. The worm 13 realizes an axial rotation through the engine and further drives the worm gear 14 to rotate.

The lubricating oil casing 9 is covered with the insulating layer 8 for blocking the high-temperature flue gas transmitted along the axial direction outside the insulating layer 8, thereby avoiding the rotating shaft 11 and the high-temperature resistant bearings 5 being in a high-temperature environment for a long time. A layer of corrosion-resistant steel 10 is provided on an outside of the insulating layer 8 to improve the mounting support for the insulating layer 8.

The cold water pipe is coiled and configured inside the insulating layer 8. Both ends of the cold water pipe extend out from the fan casing 3 to form a cold water pipe inlet 6 and a cold water pipe outlet 7, respectively. The inside of the insulating layer 8 is cooled by injecting cold water into the cold water pipe.

The working principle of the present invention is as follows. The kinetic energy of the engine is transmitted through the worm gear and the worm. The kinetic energy of the engine is first transmitted to the rotating shaft to drive the axial flow fan blades to rotate. The faster the axial flow fan blades rotate, the higher the emission efficiency of the flue gas will be. In addition, in order to ensure the service life of the rotating shaft and the high-temperature resistant bearing, the thermal insulation is achieved by coating the insulating layer 8 on the outside of the lubricating oil casing 9. Also, a cold water pipe is provided inside the insulating layer 8. Cold water is injected into the cold water pipe coiled and configured inside the insulating layer 8 to reduce the working temperature of the rotating shaft and the high-temperature resistant bearing, thereby ensuring the normal operation of the axial flow fan blades and prolonging the service life of the entire fan.

When applied to the ship desulfurization system, the present invention has the advantages of high-temperature resistance and improved flue gas emission efficiency. The equipment has a cooling device on its own, which can significantly prolong the service life of the axial flow fan and reduce maintenance and repair costs. In addition, the present invention has the advantages of compact structure, small volume and space saving, and is convenient for maintenance and installation.

The above embodiments are not intended to limit the present invention, and the present invention is not limited to the above examples. Any variations, modifications, additions or substitutions made by those skilled in the art within the scope of the technical solutions of the present invention also fall within the protective scope of the present invention.

What is claimed is:

1. An axial flow fan for a ship desulfurization system, comprising a fan casing operatively securable along an axial direction in a flue gas transmission pipeline of the ship desulfurization system, axial flow fan blades, an insulating layer, and a cold water pipe; wherein the axial flow fan blades are located at an inner front end of the fan casing and arranged on a circle concentric with a rotating shaft that is inserted in a middle of the axial flow fan blades;

a middle part of the rotating shaft is sleeved with a first bearing and a second bearing and the first bearing and the second bearing are spaced apart; outside of the first bearing and the second bearing are fixedly provided with a cruciform axis support;

a rear end of the rotating shaft is sleeved with a worm gear, and an upper end of the worm gear is provided with a worm; the worm gear meshes with the worm; the worm gear and the worm are configured inside a lubricating oil casing; and the worm gear is configured to rotate along an axis under a driving of the worm, and to further rotate the rotating shaft and the axial flow fan blades;

the lubricating oil casing is covered with the insulating layer for blocking a flue gas transmitted along the axial direction outside the insulating layer, thereby avoiding the rotating shaft, the first bearing and the second bearing being adapted to be capable of being in the flue gas transmission pipeline and exposed to the flue gas; a layer of steel is provided on an outside of the insulating layer to improve a mounting support for the insulating layer; and the cold water pipe is coiled inside the insulating layer; both ends of the cold water pipe extend out from the fan casing to form a cold water pipe inlet and a cold water pipe outlet, respectively; and an inside of the insulating layer is cooled by injecting cold water into the cold water pipe wherein the fan case further comprises an axial flow inlet upstream of the axial flow fan blades, an axial flow outlet downstream of the fan blades, and a sidewall extending from the axial flow inlet to the axial flow outlet, wherein the lubricating oil casing extends from the sidewall to the rear end of the rotating shaft, and wherein the worm extends radially outward from the rotating shaft such that an outer end of the worm is disposed radially outside the sidewall.

2. The axial flow fan for the ship desulfurization system according to claim 1, wherein the axial flow fan blades are fixedly configured at a front end of the rotating shaft through an end closed nut.

3. The axial flow fan for the ship desulfurization system according to claim 1, wherein a front end of the lubricating oil casing is connected to and directly contacts a rear end of the axis support, and the first bearing and the second bearing are configured at an end of the lubricating oil casing, so that an inside of the lubricating oil casing forms a closed space, and the closed space is filled with the lubricating oil.

4. The axial flow fan for the ship desulfurization system according to claim 1, wherein an outer end of the worm is connected to an output shaft of an engine through a power device; and the worm realizes an axial rotation through the engine and further drives the worm gear to rotate.

* * * * *